United States Patent [19]

Bliemeister

[11] 4,118,180

[45] Oct. 3, 1978

[54] ROTARY KILN SERVICE STANDS

[75] Inventor: Robert M. Bliemeister, Milwaukee, Wis.

[73] Assignee: Allis-Chalmers Corporation, Milwaukee, Wis.

[21] Appl. No.: 794,476

[22] Filed: May 6, 1977

[51] Int. Cl.[2] ..... F27B 7/22

[52] U.S. Cl. ..... 432/103; 248/130; 308/203; 308/204; 432/104

[58] Field of Search ..... 432/103-105, 432/115, 118; 248/130; 308/203, 204

[56] References Cited

U.S. PATENT DOCUMENTS

| | | | |
|---|---|---|---|
| 1,891,995 | 12/1932 | Marcy | 248/130 |
| 2,260,321 | 10/1941 | How | 308/203 |
| 2,884,287 | 4/1959 | Sommer | 308/203 |
| 3,036,823 | 5/1962 | Taylor | 432/103 |
| 3,188,155 | 6/1965 | Kemnitz | 308/204 |
| 3,711,075 | 1/1973 | Raevsky et al. | 432/103 |

FOREIGN PATENT DOCUMENTS

| | | | |
|---|---|---|---|
| 611,813 | 1/1961 | Canada | 432/103 |

*Primary Examiner*—Henry C. Yuen
*Attorney, Agent, or Firm*—Robert C. Jones

[57] ABSTRACT

A service stand integral with the rotary kiln carrying mechanism to facilitate field maintenance of the kiln roller supports and eliminate the danger inherent in field constructed blocking.

7 Claims, 6 Drawing Figures

ROTARY KILN SERVICE STANDS

BACKGROUND OF THE INVENTION

The present invention relates to rotary kiln structure and more particularly to the supporting structure for the kiln. Rotary kilns are operatively supported on massive rollers and bearings which require periodic maintenance. This maintenance is necessary because of wear and tear resulting from the service and environmental conditions that the kilns are subjected to. In addition, the rotary kilns are usually constructed well above ground level to permit convenient material flow in the subsequent equipment. This arrangement, of course, presents problems since the kiln roller supports themselves must necessarily be elevated. To this purpose, piers for the roller supports are of a height which make it difficult to service the support rollers. In following past practice, jacks and blocking had to be provided to the top of the piers so that suitable temporary supporting structures could be built under the kiln to relieve the support rollers of the tremendous weight of the kiln and free the rollers for service.

SUMMARY OF THE INVENTION

The invention provides for a kiln support pedestal arrangement which is integral with the roller support structure. The fabricated pedestal presents pad receiving surfaces which are spaced apart and adapted to receive pads or blocks on which the riding ring of the kiln will rest. The pedestals are permanent with the pads or blocks being removable. Covers for the pad receiving surfaces are provided to keep these surfaces free of dust and dirt. With pads in position, the kiln support rollers can be moved out of operating position so that maintenance work may be easily performed. The arrangement eliminates the need for jacks and blocking thereby keeping the limited working area free and clear and thereby contributing to the safety of personnel who must work on the support roller on top of the piers.

It is a general object of the present invention to provide a rotary kiln support means which incorporates a rotary support arrangement and integral fixed support pedestals.

Another object of the present invention is to provide safety support pedestals which are integral with the rotary support for supporting a rotary kiln.

DESCRIPTION OF THE DRAWINGS

FIG. 4 is a plan view of a rotary and stationary kiln support shown in FIGS. 2 and 3, the support rollers are broken away and the kiln omitted to more clearly show the stationary support structure;

DESCRIPTION OF THE INVENTION

Figure 1:
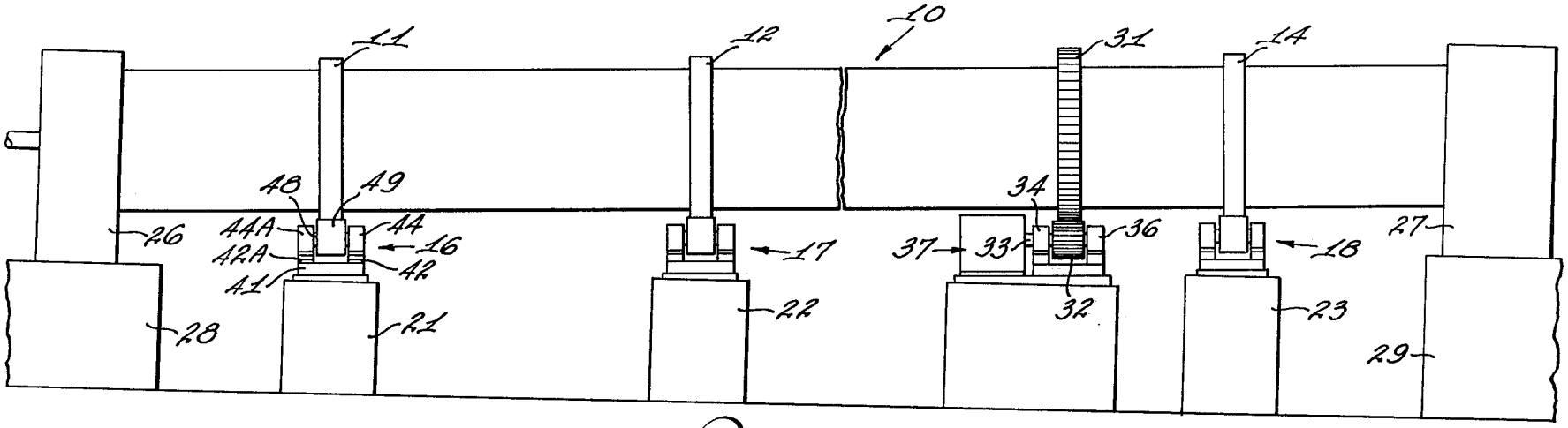
FIG. 1 is a partial view in side elevation of a rotary kiln showing several piers on which the structures of the present invention are located.
Figure 3:
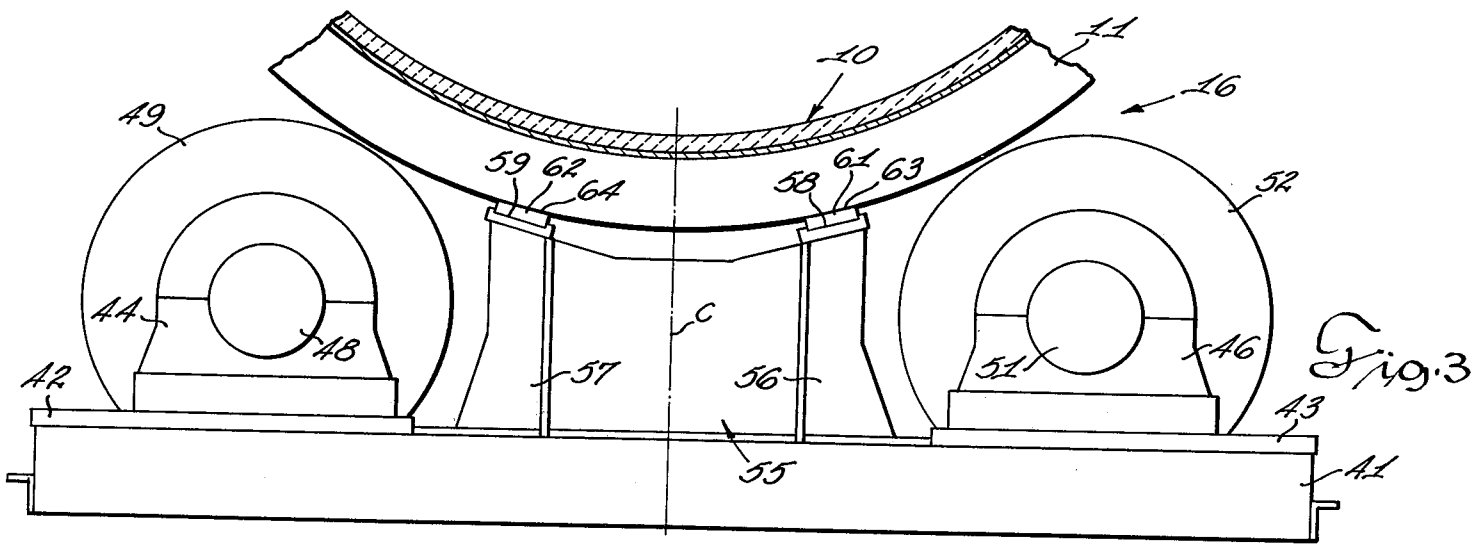
FIG. 3 is a view similar to that of FIG. 2 except that the stationary supports are operatively conditioned to support the kiln while the rotary supports are moved out for servicing.
Figure 1:
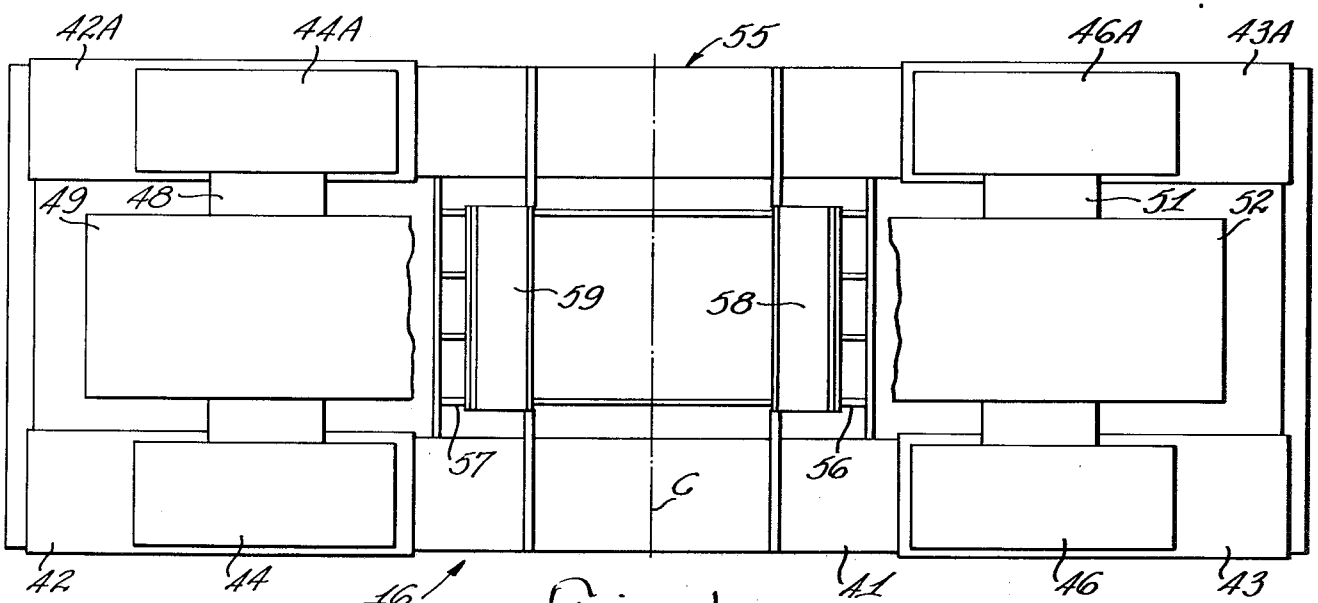

A rotary kiln 10 is disclosed in FIG. 1 which is operatively supported by rotary and stationary kiln supports 16, 17 and 18. The supports 16, 17 and 18 are each mounted on the top surface of piers 21, 22 and 23, respectively. The ends of the kiln are enclosed by housings 26 and 27 which are mounted on piers or structures 28 and 29, respectively.

The kiln is rotated by means of a bull gear 31 mounted about the exterior of the kiln and disposed in meshing engagement with a spur driving gear 32. The spur gear 32 is mounted on a shaft 33 supported in trunnions 34–36 and power driven by motor driven gear reduction unit 37.

All of the rotary and stationary supports 16, 17 and 18 are similar. Thus, a description of the support 16 will also apply to the supports 17 and 18. The support 16 includes a base 41 fabricated of steel plate that is welded together to form a box. The top surface of the base 41 accommodates a pair of slide plate sets, each set comprising a slide plate 42–42A and 43–43A. The slide plates each carry a bearing support member 44, 44A, 46 and 46A, respectively. A shaft 48 provided with a support roller 49 is rotatably supported for rotation in the bearing supports 44 and 44A. A similar arrangement is afforded to an opposite member in that a shaft 51 provided with a support roller 52 is supported for rotation in the bearing support members 46 and 46A.

Figure 2:
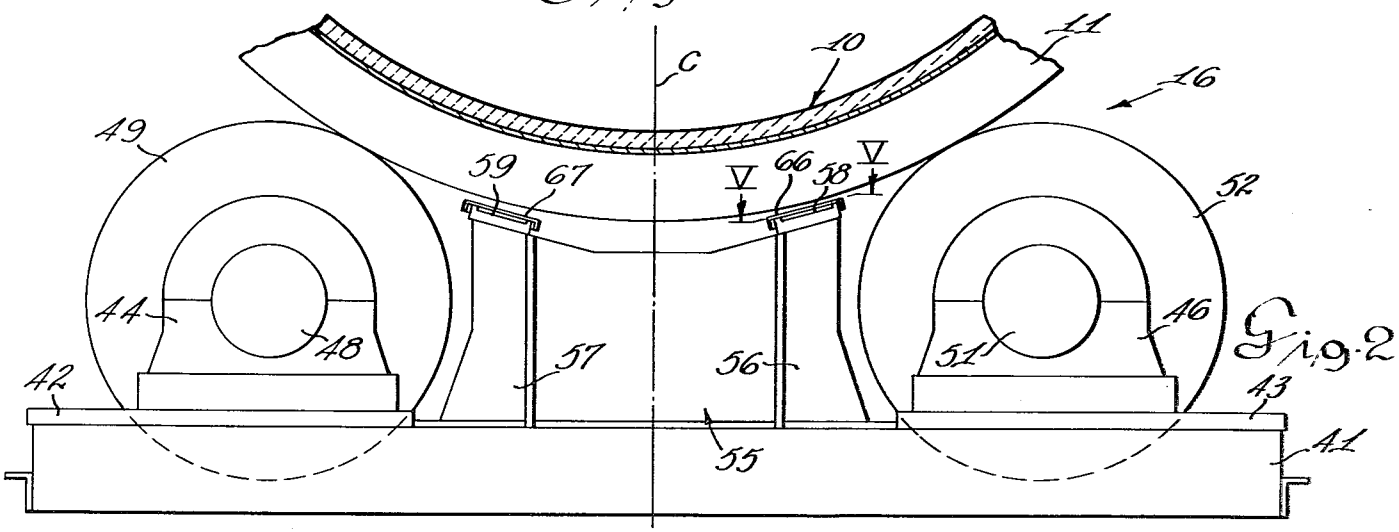
FIG. 2 is a fragmentary view in front elevation of a rotary and stationary kiln support of the present invention, with the rotary supports in operating position with respect to the kiln riding ring and the covers for the stationary support in place.

Each of the bearing support members 44–44A and 46–46A are slidably positionable on the base 41 for effecting the positioning of the associated support rollers 49 and 52, respectively, in operative roller supporting engagement with the riding ring 11, as shown in FIG. 2.

As previously mentioned, the bearing supports and support rollers require servicing from time to time. With the limited space available on the pier 21 jacks and blocking for supporting the kiln to free the support rollers for servicing can create a hazard to personnel. To eliminate this condition and to facilitate servicing in the field, an integral stationary support arrangement has been integrally incorporated with the rotary support means to act in conjunction therewith.

Figure 5:
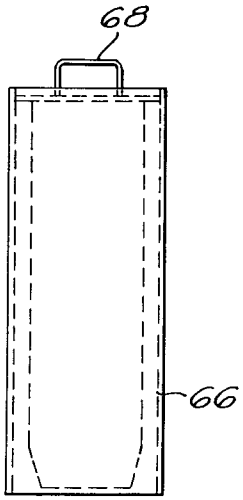
FIG. 5 is a plan view of a cover for a pad receiving surface of the stationary support; and, FIG. 6 is a fragmentary view in elevation of a pad of a stationary support, showing the cover in place.
Figure 6:
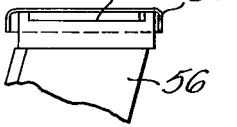

To this purpose, the stationary support generally indicated by the reference number 55 is located intermediate of the rotary support structure. As shown, the stationary support 55 includes a pair of fabricated upstanding spaced apart pedestals 56 and 57. Each of the pedestals 56 and 57 are formed with pad block receiving recesses 58 and 59, respectively. The recesses 58 and 59 have a length that is approximately as long as the width of the support rollers. Pad blocks 61 and 62 are adapted to be removably inserted into the recesses 58 and 59 and when so inserted locate their top surfaces 63 and 64 above the pedestal surfaces. When the pad blocks 61 and 62 are not in use, the receiving recesses 58 and 59 are covered by flanged covers 66 and 67, respectively, shown in FIG. 2, the cover 66 being shown in detail in FIGS. 5 and 6. As shown in FIG. 5, the cover 66 has a hand grip 68 for convenience of slipping the cover from its position on the pedestal. With the pad blocks 61 and 62 removed, the surfaces are covered by the covers 66 and 67 to protect the surfaces from an accumulation of dust and dirt. However, when the stationary pedestals are to be used, the covers 66 and 67 are removed and the pad blocks 61 and 62 inserted into position. The bearings 44–44A and 46–46A are then moved away from the centerline C to withdraw the support rollers 49 and 52 gradually out of engagement with the riding ring 11. As the withdrawal movement occurs, the riding ring engages the pad blocks 61 and 62 and is supported thereon. With the riding ring on the blocks 61 and 62, support for the kiln is obtained and the support rollers can be withdrawn as far as may be desired so as to provide adequate servicing room.

While the stationary support 55 has been described as having removable pad blocks 61 and 62, it is, of course, understood that the blocks 61 and 62 can be made as an integral part of the pedestal surfaces 58 and 59. The removable pad block arrangement is preferred in that advantages are obtained which are not obtainable with integral surfaces. One advantage is that due to convection the heat within the kiln is conducted through the steel kiln shell and then to the riding ring 14. The heat from the hot riding ring will be imparted to the stationary support surface if such surface is too close to the ring. Thus, by having the pad blocks removable, an additional space dimension is obtained to add additional heat insulation clearance without the necessity of having to impart additional vertical movement to the kiln. This is important because with too much kiln displacement, the potential interference at the meshing engagement between the bull gear 31 and the drive gear 32 must be prevented, thus causing additional alignment servicing. Also, air seals, for example, between the end of the kiln and the enclosure could be impaired thereby causing additional servicing problems. Also, with the insertable pad blocks adequate operating clearance for the kiln is obtained without the necessity of displacing the kiln alignment to any great extent when servicing the support rollers.

The embodiments of the invention in which an exclusive property or privilege is claimed are defined as follows:

1. In a supporting arrangement for a rotary kiln having an axis of rotation;

a base;

support roller means mounted for movement from a kiln supporting position to a retracted service position wherein said support roller means is not in engagement with the kiln; and, stationary support means in position to receive and support the kiln when said support roller means are moved out of supporting engagement with the kiln, said stationary supporting means includes a pedestal supported on said base in position to receive and support said kiln when said supporting roller means is retracted to a servicing position, said pedestal includes a pair of spaced apart upstanding members;

a pad block receiving surface formed on each of said upstanding members constructed and arranged to provide adequate operating clearance for the rotary kiln when said kiln is supported by said supporting roller means; and pad block means insertable on each of the receiving surfaces formed on the upstanding members to provide supporting surfaces for the kiln which substantially increases the clearance distance between the pad block receiving surfaces and the kiln when said supporting roller means is in operating position.

2. A supporting arrangement according to claim 1 wherein said supporting roller means includes;

a pair of rotatable rollers disposed transversely with respect to the axis about which the kiln rotates, said rollers being movable from a kiln supporting position to a retracted servicing position wherein the rollers do not support the kiln.

3. A supporting arrangement according to claim 2 wherein said supporting roller means and said stationary support are mounted on a common base.

4. A supporting arrangement according to claim 3 wherein each of said rotatable rollers are carried on slide members, said slide members being operable to support said rotatable rollers for movement toward and away from the kiln to move the rollers into kiln supporting position or to retract the rollers to a service position.

5. A supporting arrangement according to claim 1 wherein said stationary supporting means includes a pedestal supported on said base in position to receive and support said kiln when said roller supporting means is retracted to a servicing position.

6. A supporting arrangement according to claim 1 including:

covers for said pad block receiving surfaces of said upstanding members, said covers operating to protect said pad block receiving surfaces from an accumulation of dust and dirt when said pad blocks are not in position thereon.

7. In a supporting arrangement for a rotary kiln having an axis of rotation;

a base;

a pair of rotatable roller supports disposed transversely with respect to the axis about which the kiln rotates;

a slide member for each of said rotatable roller supports, said slide members being mounted on said base in position to support said rotatable roller supports for movement there along in a direct transverse to the axis about which the kiln rotates into a kiln supporting position or to a retracted service position;

a stationary support including a pair of upstanding pedestal members disposed equidistances apart on each side of a centerline which passes through the axis about which the kiln rotates;

a pad block receiving surface formed on each of said pedestal members, said surfaces being constructed and arranged so as to provide adequate operating clearance for the rotary kiln when the kiln is operatively supported on said pair of rotatable roller supports;

a pad block insertable on each of said pad block receiving surfaces formed on each of said upstanding pedestals, said pad blocks operating to provide a supporting surface foı the kiln when said slide members are moved to retract said roller supports to a service position, said pad blocks being constructed and arranged to substantially increase the clearance distance between the receiving surfaces and the kiln; and, covers for each of said pad block receiving surfaces, said covers operating to protect said pad block receiving surfaces from an accumulation of dust and dirt when said pad blocks are not in position thereon.

* * * * *